US006848815B1

(12) United States Patent
Born

(10) Patent No.: US 6,848,815 B1
(45) Date of Patent: Feb. 1, 2005

(54) MARINE ANCHOR AND NAVIGATIONAL LIGHT SYSTEM

(76) Inventor: Thomas J. Born, 4805 Bonnerville Dr., Arlington, TX (US) 76016

( * ) Notice: Subject to any disclaimer, the term of this patent is extended or adjusted under 35 U.S.C. 154(b) by 0 days.

(21) Appl. No.: 10/425,142

(22) Filed: Apr. 30, 2003

(51) Int. Cl.[7] ..... B63B 45/04

(52) U.S. Cl. ..... 362/477; 362/287; 362/419; 362/226

(58) Field of Search ..... 362/477, 226, 362/275, 287, 418, 419, 191, 285, 431; 114/343; 403/109.1

(56) References Cited

U.S. PATENT DOCUMENTS 3,388,249 A * 6/1968 Orbach et al. ..... 362/269
4,554,620 A * 11/1985 Warshawsky ..... 362/269
5,142,457 A * 8/1992 Wehner ..... 362/477
5,416,670 A * 5/1995 Authier ..... 362/34
5,486,987 A * 1/1996 Fritz, Jr. ..... 362/226
6,155,195 A * 12/2000 Nirenberg ..... 114/343
6,164,803 A * 12/2000 Reniger et al. ..... 362/477

* cited by examiner

*Primary Examiner*—Alan Cariaso
*Assistant Examiner*—Ali Alavi

(57) ABSTRACT

A marine anchor and navigational light system for providing flexible and resilient lights which cannot be damaged. The marine anchor and navigational light system includes a boat; and also includes base assemblies including base members being fastened to the boat and also including electrical plug members being attached to the base members and being connected to wires; and further includes first tubular members each being detachably connected to a respective one of the electrical plug members; and also includes elongate bendable tubular linkage members each being securely attached to a respective one of the first tubular members; and further includes second tubular members each being detachably connected to a respective one of the elongate flexible tubular linkage members; and also includes light-emitting assemblies including combination light-emitting socket and plug members each being detachably connected to a respective one of the second tubular members, and also including light-emitting members being removably connected to the combination light-emitting socket and plug members.

10 Claims, 3 Drawing Sheets

MARINE ANCHOR AND NAVIGATIONAL LIGHT SYSTEM

BACKGROUND OF THE INVENTION

1. Field of the Invention

The present invention relates to boat light systems and more particularly pertains to a new marine anchor and navigational light system for providing flexible and resilient lights which cannot be damaged.

2. Description of the Prior Art

The use of boat light systems is known in the prior art. More specifically, boat light systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,486,987; U.S. Pat. No. 5,746,642; U.S. Pat. No. 5,892,445; U.S. Pat. No. 5,379,197; U.S. Pat. No. 6,155,195; and U.S. Pat. No. Des. 364,935.

While these devices fulfill their respective, particular objectives and requirements, the aforementioned patents do not disclose a new marine anchor and navigational light system. The prior art includes base members, tubular support member, flexible tubular members, and light-emitting members.

SUMMARY OF THE INVENTION

The general purpose of the present invention, which will be described subsequently in greater detail, is to provide a new marine anchor and navigational light system which has many of the advantages of the boat light systems mentioned heretofore and many novel features that result in a new marine anchor and navigational light system which is not anticipated, rendered obvious, suggested, or even implied by any of the prior art boat light systems, either alone or in any combination thereof. The present invention includes a boat; and also includes base assemblies including base members being fastened to the boat and also including electrical plug members being attached to the base members and being connected to wires; and further includes first tubular members each being detachably connected to a respective one of the electrical plug members; and also includes elongate bendable tubular linkage members each being securely attached to a respective one of the first tubular members; and further includes second tubular members each being detachably connected to a respective one of the elongate flexible tubular linkage members; and also includes light-emitting assemblies including combination light-emitting socket and plug members each being detachably connected to a respective one of the second tubular members, and also including light-emitting members being removably connected to the combination light-emitting socket and plug members. None of the prior art includes the combination of the elements of the present invention.

There has thus been outlined, rather broadly, the more important features of the marine anchor and navigational light system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new marine anchor and navigational light system which has many of the advantages of the boat light systems mentioned heretofore and many novel features that result in a new marine anchor and navigational light system which is not anticipated, rendered obvious, suggested, or even implied by any of the prior art boat light systems, either alone or in any combination thereof.

Still another object of the present invention is to provide a new marine anchor and navigational light system for providing flexible and resilient lights which cannot be damaged.

Still yet another object of the present invention is to provide a new marine anchor and navigational light system that is easy and convenient to set up and use.

Even still another object of the present invention is to provide a new marine anchor and navigational light system that can be easily removed from the boat and can also be easily adjusted by the user as needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
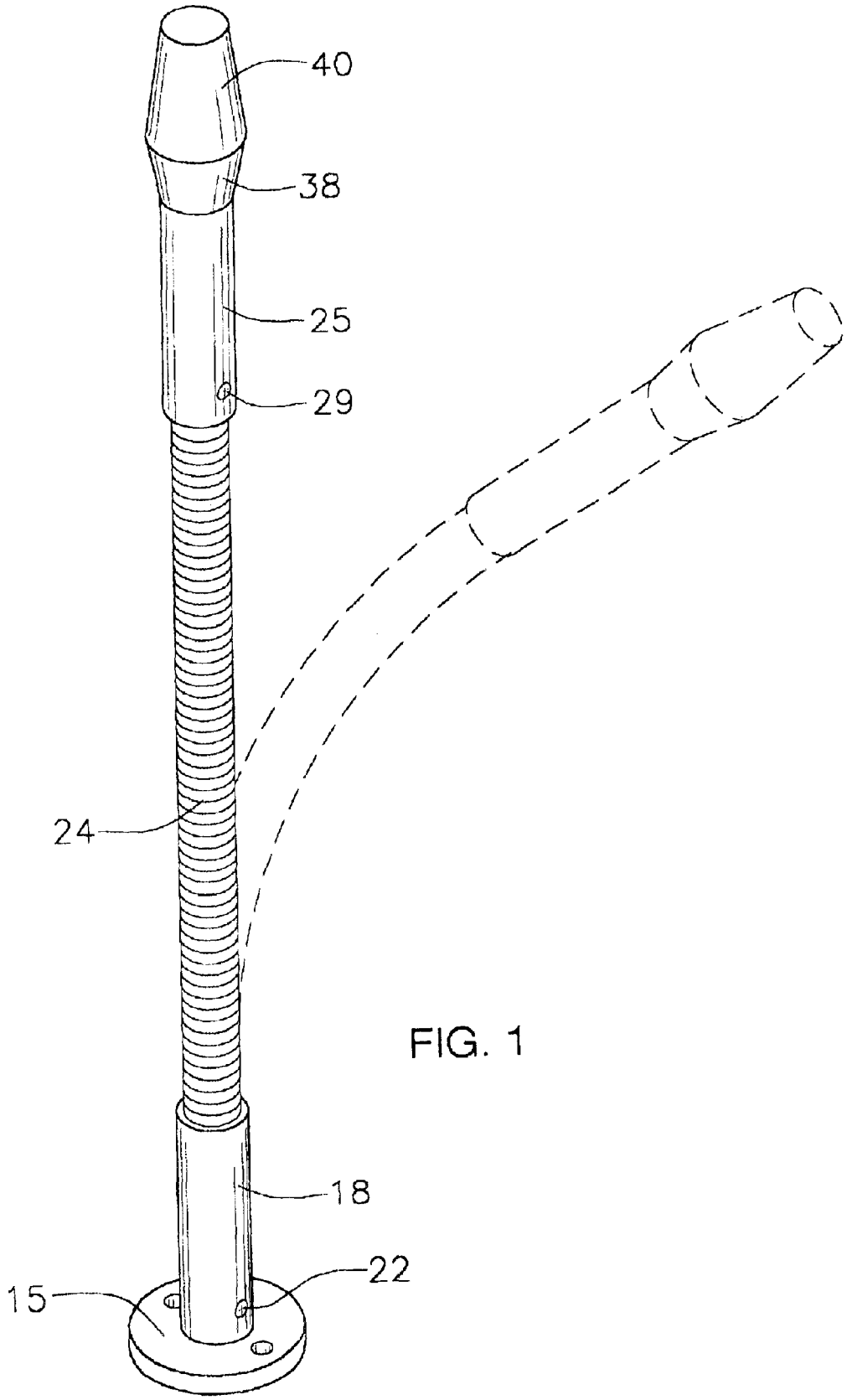
FIG. 1 is a perspective view of a new marine anchor and navigational light system according to the present invention.
Figure 2:
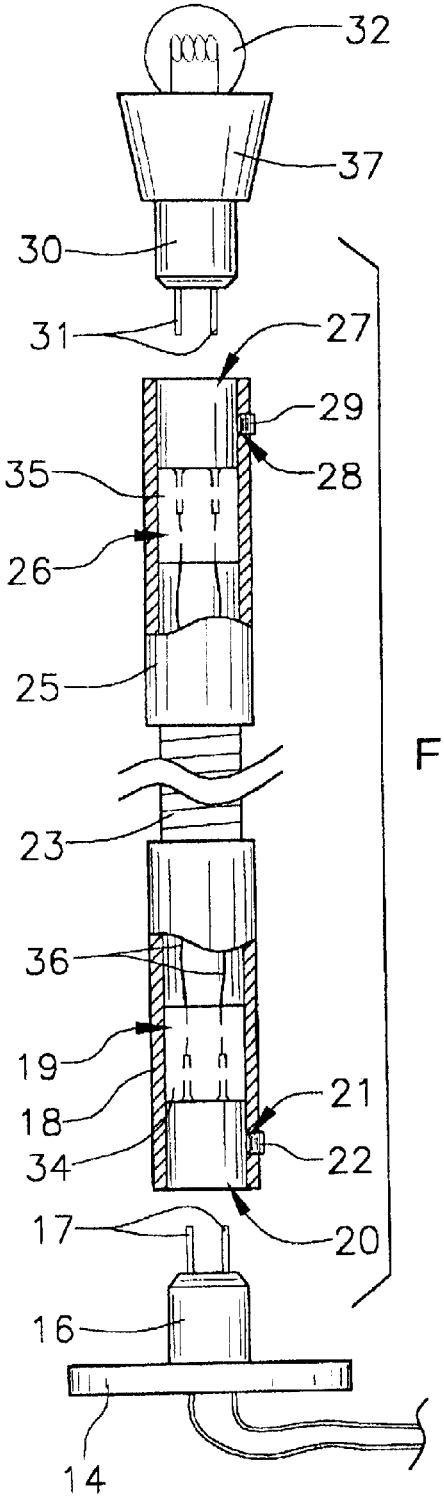
FIG. 2 is a cutaway exploded side elevational view of the present invention.
Figure 3:
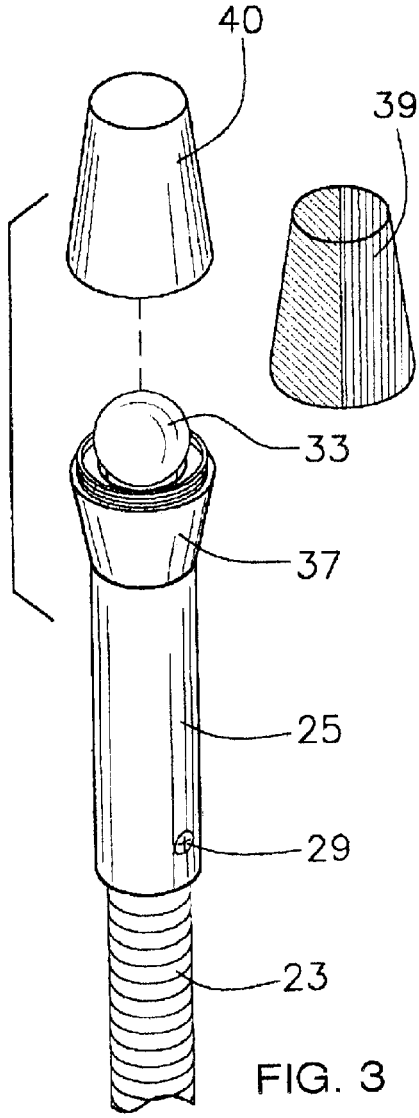
FIG. 3 is a partial perspective view of the present invention.
Figure 4:
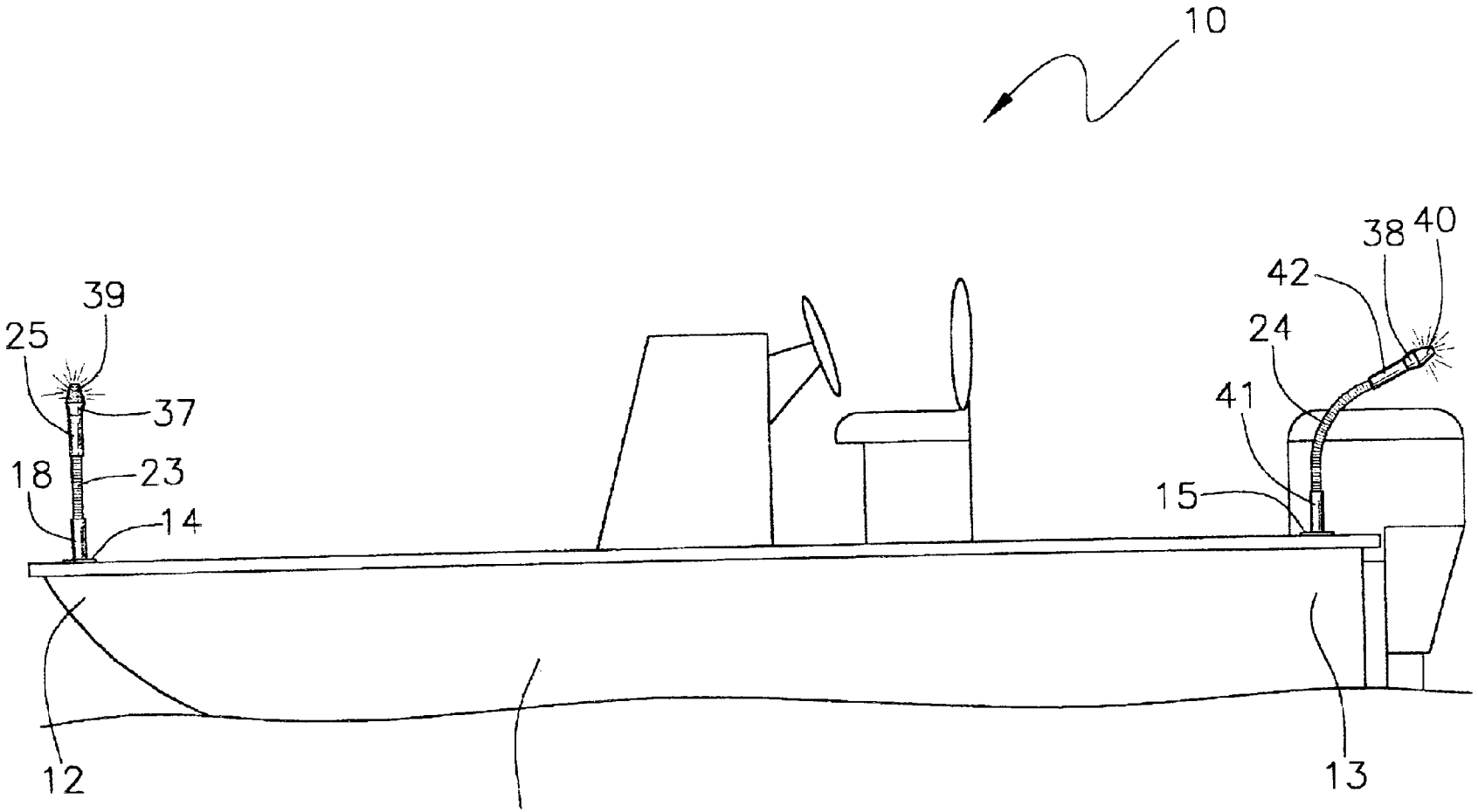
FIG. 4 is a side elevational view of the present invention shown in use.

With reference now to the drawings, and in particular to FIGS. 1 through 4 thereof, a new marine anchor and navigational light system embodying the principles and concepts of the present invention and generally designated by the reference numeral 10 will be described.

As best illustrated in FIGS. 1 through 4, the marine anchor and navigational light apparatus 10 generally comprises a boat 11. The boat 11 has a bow section 12 and a stern section 13.

Base assemblies include base members 14,15 being securely and conventionally fastened to the boat 11 and also including electrical plug members 16,17 being conventionally attached to the base members 14,15 and being securely connected to wires. The base members 14,15 include a first base member 14 which is fastened with fasteners to the bow section 12 of the boat 11, and also include a second base member 15 which is fastened with fasteners to the stern section 13 of the boat 11. The first and second base members 14,15 are disc-shaped plates. Each of the electrical plug members 16,17 includes a plug body 16 being securely and conventionally attached to a respective one of the first and second base members 14,15, and also includes prongs 17 extending outwardly from the plug body 16.

The marine anchor and navigational light system 10 also comprises first tubular members 18,41 each being detachably and conventionally connected to a respective one of the electrical plug members 16,17. Each first tubular member 18,41 has open bottom ends 20, and also has a bore 19 being disposed therethrough, and further has a hole 21 being disposed through a side wall thereof and receiving a first setscrew 22 for fastening the first tubular member 18,41 to a respective plug body 16.

The marine anchor and navigational light system 10 further comprises elongate bendable tubular linkage members 23,24 each being securely and conventionally attached to a respective one of the first tubular members 18,41. The elongate bendable tubular linkage members 23,24 have bottom ends which are securely and conventionally attached to top ends of the first tubular members 18,41.

The marine anchor and navigational light system 10 also comprises second tubular members 25,42 each being detachably and conventionally connected to a respective one of the flexible tubular linkage members 23,24. Each second tubular member 25,42 has an open top end 27, and also has a bore 26 being disposed therethrough, and further has a hole 28 being disposed through a side wall thereof and receiving a second setscrew 29, and has a bottom end which is securely and conventionally attached to a top end of a respective elongate bendable tubular linkage member 23,24.

Light-emitting assemblies include combination light-emitting socket and plug members 30,31 each being detachably connected to a respective one of the second tubular members 25,42, and also include light-emitting members 32,33 being removably connected to the combination light-emitting socket and plug members 30,31. The light-emitting assemblies further include first plug-receiving sockets 34 being conventionally disposed in the bores 19 of the first tubular members 18,41 near the open bottom ends 20 thereof and removably receiving the prongs 17 of the electrical plug members 16,17, and also include second plug-receiving sockets 35 being conventionally disposed in the bores 26 of the second tubular members 25,42 near the open top ends 27 thereof and being conventionally connected to the first plug-receiving sockets 34 with wires 36. The combination light-emitting socket and plug members 30,31 have prongs 31 being extended therefrom and being removably received in the second plug-receiving sockets 35 with the combination light-emitting socket and plug members 30,31 being fastened with the second setscrews 29 to the second tubular members 25,42. The light-emitting assemblies also include conical-shaped cover support members 37,38 being securely and conventionally mounted about the combination light-emitting socket and plug members 30,31, and further include color-tinted transparent conical-shaped cover members 39,40 being detachably threaded to the conical-shaped cover support members 37,38 with one of the color-tinted transparent conical-shaped cover members 40 being colored white and the other of the color-tinted transparent conical-shaped cover members 39 being colored green and red.

In use, the marine anchor and navigational light system 10 is energized by a battery for the boat so as to provide adjustable lights at the bow section 12 of the boat 11 and at the stern section 13 of the boat 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the marine anchor and navigational light system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A marine anchor and navigational light system comprising:

a boat;

base assemblies including base members being fastened to said boat and also including electrical plug members being attached to said base members and being connected to wires;

first tubular members each being detachably connected to a respective one of said electrical plug members;

elongate bendable tubular linkage members each being securely attached to a respective one of said first tubular members;

second tubular members each being detachably connected to a respective one of said flexible tubular linkage members; and light-emitting assemblies including combination light-emitting socket and plug members each being detachably connected to a respective one of said second tubular members, and also including light-emitting members being removably connected to said combination light-emitting socket and plug members.

2. The marine anchor and navigational light system as described in claim 1, wherein said boat having a bow section and a stern section.

3. The marine anchor and a navigational light system as described in claim 2, wherein said base members include a first base member which is fastened to said stern section of said boat, and also include a second base member which is fastened to said bow section of said boat, said first and second base member being disc-shaped plates.

4. The marine anchor and navigational light system as described in claim 3, wherein each of said electrical plug members includes a plug body being securely attached to a respective one of said first and second base members, and also includes prongs extending outwardly from said plug body.

5. The marine anchor and navigational light system as described in claim 4, wherein each said first tubular member has an open bottom end, and also has a bore being disposed therethrough, and further has a hole being disposed through a side wall thereof and receiving a first setscrew for fastening said first tubular member to a respective said plug body.

6. The marine anchor and navigational light system as described in claim 5, wherein said elongate bendable tubular linkage members have bottom ends which are securely attached to top ends of said first tubular members.

7. The marine anchor and navigational light system as described in claim 6, wherein each said second tubular members has an open top end, and also has a bore being disposed therethrough, and further has a hole being disposed through a side wall thereof and receiving a second setscrew and has a bottom end which is securely attached to a top end of a respective said elongate bendable tubular linkage member.

8. The marine anchor and navigational light system as described in claim 7, wherein said light-emitting assemblies further includes first plug-receiving sockets being disposed in said bores of said first tubular members near said open bottom ends thereof and removably receiving said prongs of said electrical plug members, and also includes second plug-receiving sockets being disposed in said bores of said second tubular members near said open top ends thereof and being connected to said first plug-receiving sockets with wires.

9. The marine anchor and navigational light system as described in claim 8, wherein said combination light-emitting socket and plug members have prongs being extended therefrom and being removably received in said second plug-receiving sockets with said combination light-emitting socket and plug members being fastened with said second setscrews to said second tubular members.

10. The marine anchor and navigational light system as described in claim 9, wherein said light-emitting assemblies also include conical-shaped cover support members being securely mounted about said combination light-emitting socket and plug members, and further includes color-tinted transparent conical-shaped cover members being detachably threaded to said conical-shaped cover support members, one of said color-tinted transparent conical-shaped cover members being colored white and the other of said color-tinted transparent conical-shaped cover members being colored green and red.

* * * * *